US007695161B2

(12) United States Patent
Zhang et al.

(10) Patent No.: US 7,695,161 B2
(45) Date of Patent: Apr. 13, 2010

(54) HEAT DISSIPATION DEVICE FOR LIGHT EMITTING DIODE MODULE

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 249 days.

(21) Appl. No.: 11/937,413

(22) Filed: Nov. 8, 2007

(65) Prior Publication Data

US 2009/0120612 A1 May 14, 2009

(51) Int. Cl.
*F21V 29/00* (2006.01)

(52) U.S. Cl. ..... 362/294; 362/218; 362/249.02; 362/373; 361/703; 361/777; 165/80.3; 257/722

(58) Field of Classification Search ..... 362/294, 362/373, 800, 218, 249.02; 361/703, 717; 165/80.3; 257/722
See application file for complete search history.

(56) References Cited

U.S. PATENT DOCUMENTS 7,513,639 B2 * 4/2009 Wang ..... 362/294
7,553,047 B2 * 6/2009 Shin et al. ..... 362/294

FOREIGN PATENT DOCUMENTS

TW 556074 10/2003
TW M288918 3/2006

* cited by examiner

*Primary Examiner*—Stephen F Husar
(74) *Attorney, Agent, or Firm*—Frank R. Niranjan

(57) ABSTRACT

A heat dissipation device includes a heat sink and an LED module attached to the heat sink. The heat sink includes a base and a plurality of fins mounted on the base. A plurality of channels is defined between the fins of the heat sink and slits are defined in two opposite side edges of the base. The slits extend through the base and corresponding fins and cross with corresponding channels. A plurality of grooves is defined in the fins opposite to the LED module. Each of the grooves interconnects corresponding two aligned slits.

12 Claims, 5 Drawing Sheets

HEAT DISSIPATION DEVICE FOR LIGHT EMITTING DIODE MODULE

BACKGROUND OF THE INVENTION

1. Field of the Invention

The present invention relates to a heat dissipation device, and more particularly to a heat dissipation device which can more effectively dissipate heat on the device by air convection, wherein the device is used for mounting a light emitting device module thereon.

2. Description of Related Art

A light emitting diode (LED) is a device for transferring electricity to light by using a theory that, if a current is made to flow in a forward direction through a junction region comprising two different semiconductors, electrons and holes are coupled at the junction region to generate a light beam. The LED has an advantage in that it is resistant to shock, and has an almost eternal lifetime under a specific condition, so more and more LED modules with different capabilities are being developed.

LED modules for use in a display or an illumination device require many LEDs, and most of the LEDs are driven at the same time, which results in a quick rise in temperature of the LED module. Since generally the LED modules do not have heat dissipation devices with good heat dissipating efficiencies, operation of the general LED modules has a problem of instability because of the rapid buildup of heat. Consequently, the light from the LED module often flickers, which degrades the quality of the display or illumination.

As LED technology continues to advance, more and more heat dissipation devices are applied to the LED modules for dissipating heat from the LED modules. A related heat dissipation device attached to an LED module usually comprises a heat sink having a base and a plurality of fins mounted on the base. The fins are located parallel to each other and perpendicular to the base. A plurality of channels is defined between the fins of the heat sink and arranged parallel to each other. Through a natural air convection through the channels, heat of the fins from the base by absorbing the heat generated by the LED module can be dissipated to atmosphere. Accordingly, the LED module can be cooled to some degree.

However, by the provision of the fins and the unidirectional channels defined between the fins, the natural air convection cannot have a sufficient heat exchange with the fins, whereby the heat generated by the LED module cannot be timely dissipated to surrounding atmosphere, and performance of the LED module is accordingly undesirably affected.

What is needed, therefore, is a heat dissipation device for an LED module, which can provide improved heat dissipation efficiency.

SUMMARY OF THE INVENTION

A light emitting diode (LED) assembly is disclosed. The LED assembly includes a heat sink and an LED module attached on the heat sink. The heat sink includes a base and a plurality of fins mounted on two opposite surfaces of the base. The LED module is attached to a middle portion of one of the opposite surfaces of the base in which there is no fin. A plurality of lengthwise channels is defined between the fins of the heat sink. A plurality of traverse slits is extended through the fins and the base at two opposite side edges of the base, crossing with the channels at the two opposite side edges of the base. A plurality of traverse grooves is defined in the fins attached to the other one of the opposite surfaces of the base. Each groove interconnects two corresponding transversely aligned slits. The grooves are spaced from each other a distance along a lengthwise direction of the heat sink that two transversely aligned slits are located between two neighboring grooves along the lengthwise direction of the heat sink. The channels, slits and grooves of the heat sink increase the contact area of the heat sink and air surrounding the heat sink. Furthermore, the channels, slits and grooves enable natural air convection through the heat sink via different directions, whereby heat of the fins from the base by absorbing heat from the LED module can be more effectively dissipated to the surrounding air.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
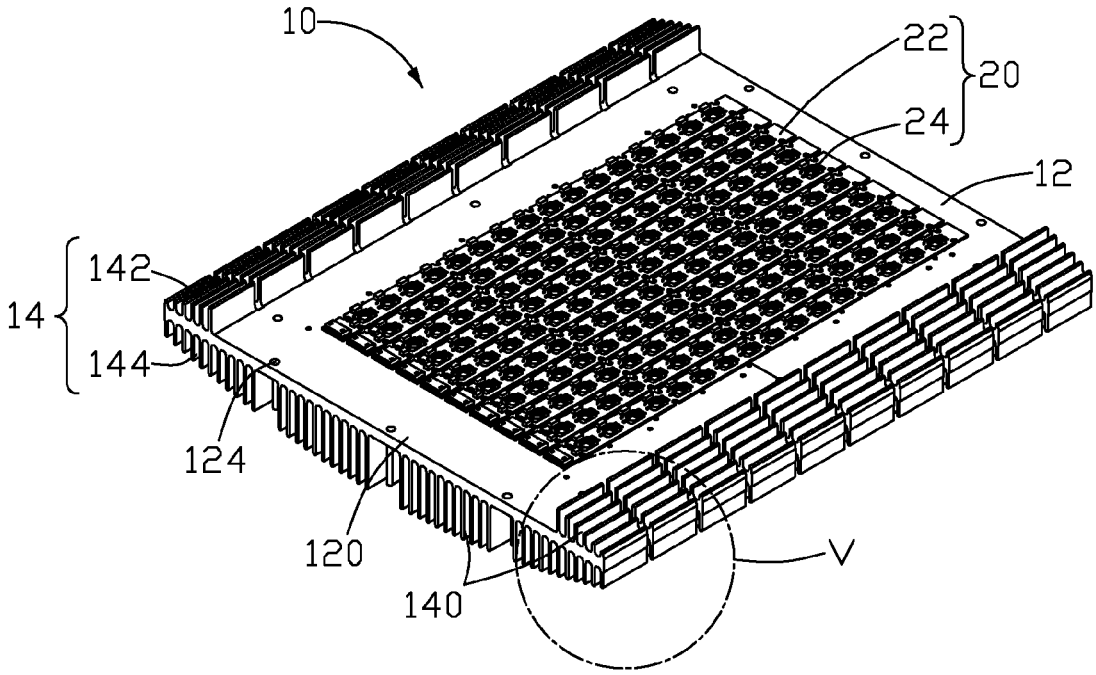
FIG. 1 is an assembly view of a heat dissipation device in accordance with a preferred embodiment of the present invention, with an LED module attached thereon.
Figure 2:
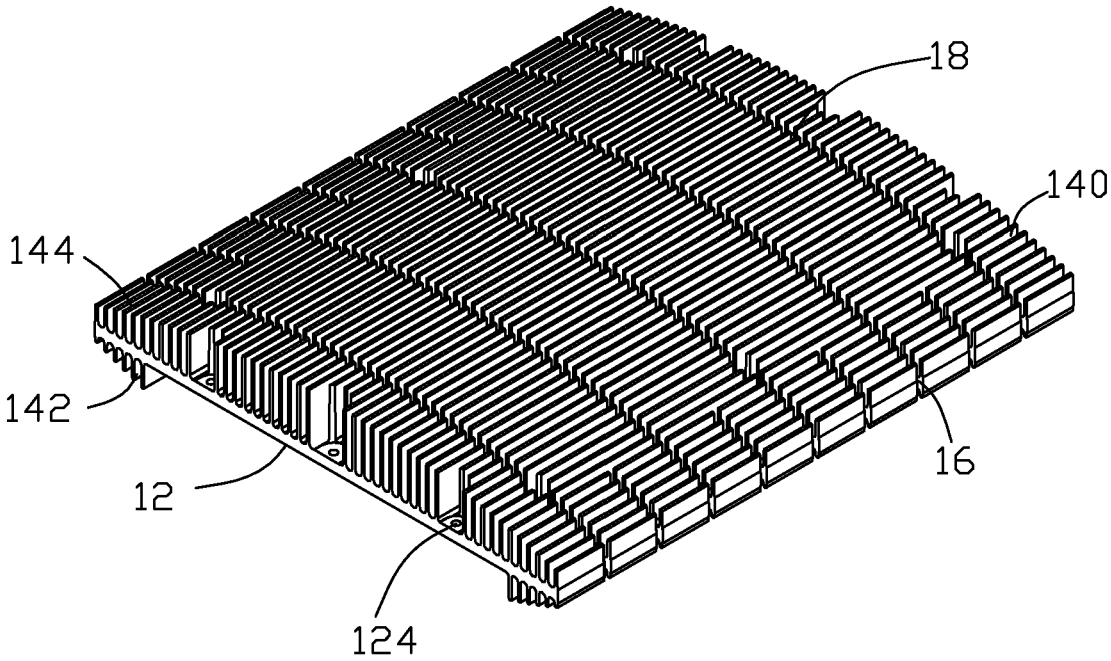
FIG. 2 is a bottom view of FIG. 1.
Figure 3:
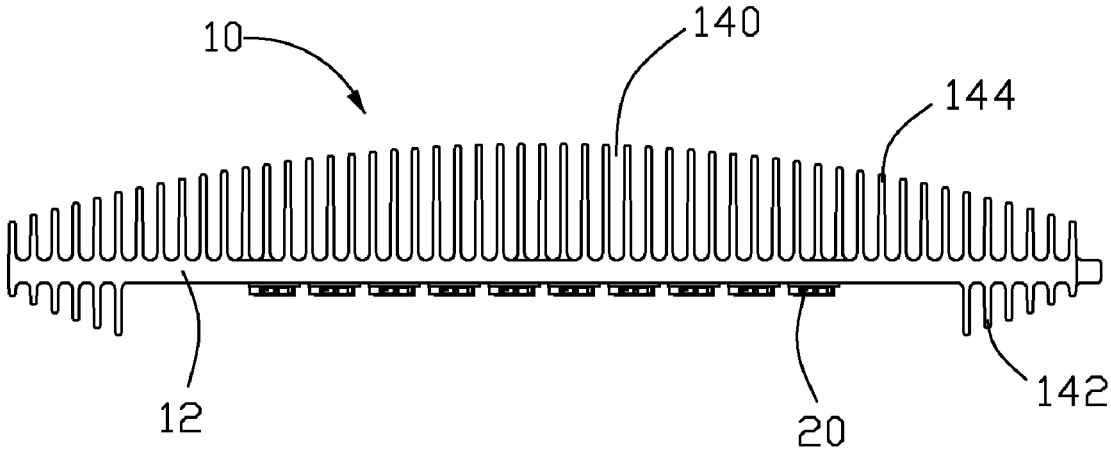
FIG. 3 is a lateral side view of FIG. 2.

Referring to FIGS. 1-3, an LED assembly in accordance with a preferred embodiment is illustrated. The LED assembly comprises a heat sink 10 and an LED module 20 attached to the heat sink 10. The heat sink 10 is used to cool down the LED module 20 to keep the LED module 20 working within an acceptable temperature range.

In this embodiment, the LED module 20 comprises several juxtaposed printed circuit boards 22 and a plurality of LEDs 24 mounted on the printed circuit boards 22. Each printed circuit board 22 has a plurality of through holes (not shown) defined therein. The through holes in the printed circuit boards 22 are arrayed in rows and lines for LEDs 24 mounted therein. Alternatively, these printed circuit boards 22 can be replaced by a larger single printed circuit board, which has a matrix of through holes defined therein. The LEDs 24 are used to be installed into the corresponding through holes of the printed circuit boards 22, electrically bonded to the printed circuit boards 22, and electrically connected to circuits (not shown) provided on the printed circuit boards 22.

The heat sink 10 comprises a base 12 and a plurality of fins 14 integrally formed from the base 12. The fins 14 are located perpendicular to the base 12 and parallel to each other along a lengthwise direction of the heat sink 10. A plurality of channels 140 is defined between the fins 14 and parallel to long sides of the base 12. In otherwise words, the channels 140 extend along the lengthwise direction of the heat sink 10. The base 12 is a substantially rectangular shape and has a first surface 120 and a second surface (not shown) opposite to the first surface 120. A plurality of through holes 124 is defined in side edges of the base 12 and arranged around the LED module 20, for fixtures (not shown) to extend therethrough to mount the LED assembly to a supporting structure (not shown). The fins 14 comprise a plurality of first fins 142 extending from the two opposite long sides of the base 12 of the heat sink 10 and around the LED module 20. Heights of the first fins 142 are gradually decreased along a traverse direction away from the LED module 20. The fins 14 further comprise a plurality of second fins 144 extending from the second surface of the base 12 opposite to the first fins 142 of the heat sink 10. Heights of the second fins 144 are gradually decreased along the traverse direction away from a middle portion of the base 12 (clearly seen from FIG. 3). Outmost ones of the first fins 142 are integrally formed with outmost ones of the second fins 144, whereby the outmost first and second fins 142, 144 cooperate to form two opposite sidewalls (not labeled) of the heat sink 10.

A plurality of transverse slits 16 is defined through outer ones of the second fins 144 and the first fins 142 located at two opposite long side edges of the base 12 of the heat sink 10 and the two opposite long side edges of the base 12 of the heat sink 10. The slits 16 interrupt a continuity of the channels 140 in the two opposite sides of the base 12 of the heat sink 10 and cross with the channels 140. The slits 16 are arranged at intervals and extend along a direction parallel to short sides of the base 12 of the heat sink 10 (i.e., the traverse direction of the heat sink 10). The slits 16 are perpendicular to the channels 140. The slits 16 are divided into a plurality of pairs each of which is transversely aligned. The outer ones of the second fins 144 and the first fins 142 formed on the opposite long side edges of the base 12 are divided into a plurality of small parts separated from each other by the slits 16.

A plurality of grooves 18 is transversely defined through the second fins 142 of the heat sink 10 and spaced from each other at predetermined intervals. The grooves 18 each interconnect a corresponding pair of slits 16. Furthermore, two neighboring grooves 18 are so spaced that a pair of slits 16 is located between the two neighboring grooves 18 along the lengthwise direction of the heat sink 10. The grooves 18 perpendicularly cross with corresponding channels 140.

Figure 4:
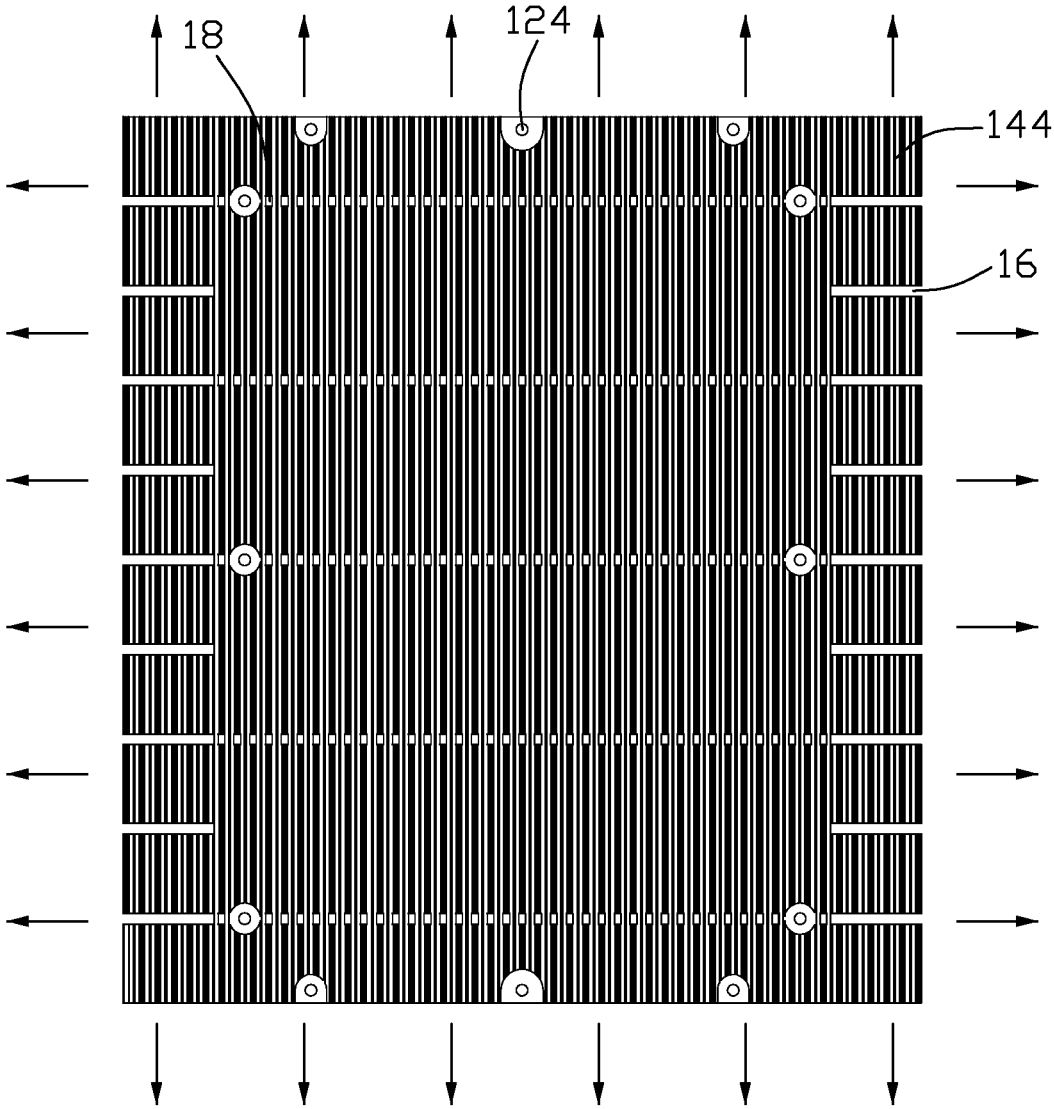
FIG. 4 is a top view of FIG. 2, showing airflow paths of the heat dissipation device.
Figure 5:
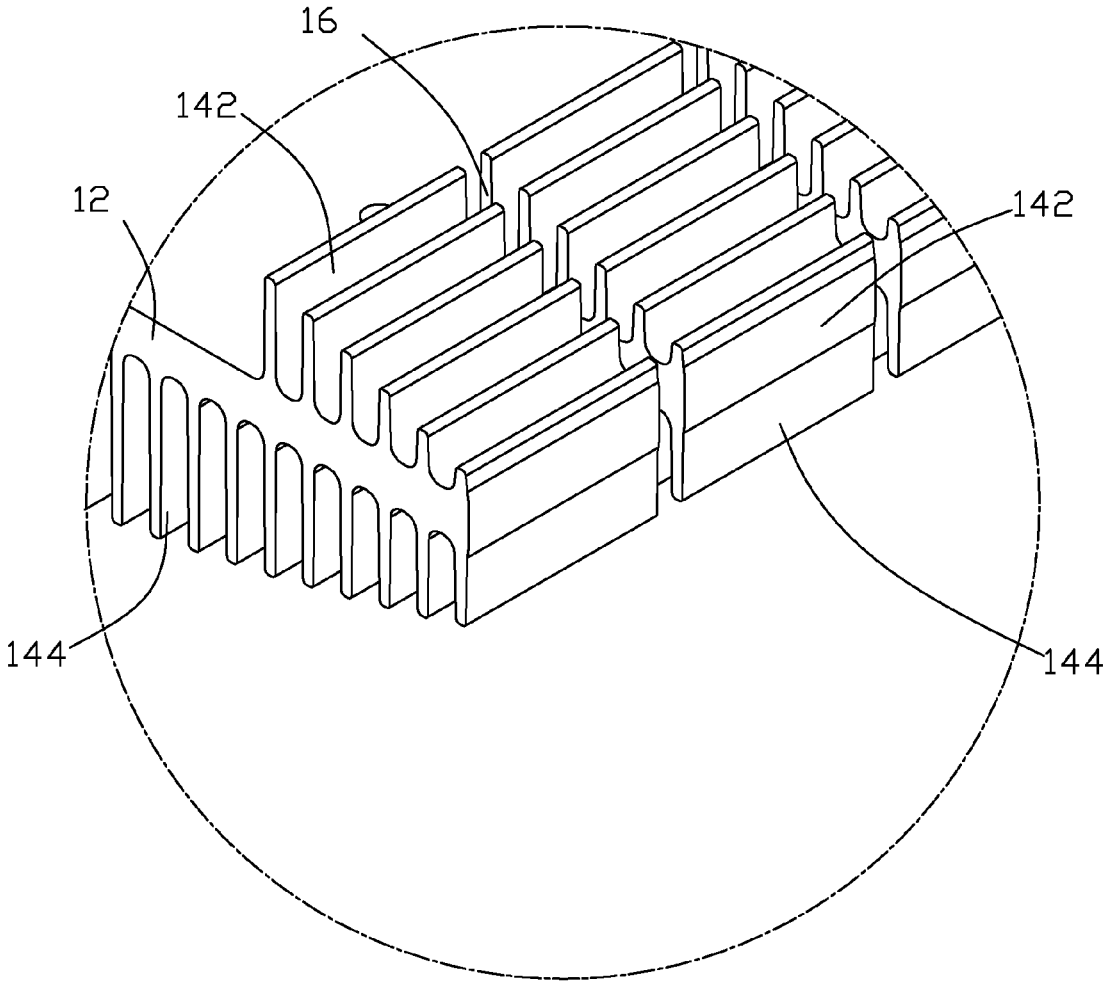
FIG. 5 is an enlarged view of a circled portion V of FIG. 1.

In operation, referring to FIG. 4, when the LED 20 module is activated to generate light, heat is generated by the LEDs 24. The heat is absorbed by the base 12. Then, the heat is transferred to the first and second fins 142, 144, whereby the heat sink 10 has a higher temperature than the surrounding air. Due to the higher temperature of the heat sink 10, a natural air convection is occurred to the heat sink 10 wherein air surrounding the first and second fins 142, 144 is heated thereby and leaves the heat sink 10. Cool air flows to replace the leaved heated air, whereby the heat in the heat sink 10 is taken away and the heat sink 10 and the LEDs 24 accordingly are cooled.

By the provision of the grooves 18 and slits 16 being defined in the first and second fins 142, 144 of the heat sink 10 and perpendicular to the channels 140 to interrupt continuity of the channels 140, as shown by arrows of FIG. 4, the heated air can leave the heat sink 10 along the traverse and lengthwise directions. Moreover, although it is not shown by the arrows in the drawings, the heated air can leave the heat sink 10 vertically through the slits 16. Finally, the provision of the channels 140, slits 16 and grooves 18 increases the contact area between the heat sink 10 and the surrounding air. Accordingly, the amount of the air heated by the fins 142, 144 can be increased and the air heated by the first and second fins 142, 144 can quickly leave the fins 142, 144 to be replaced by cool air to obtain a good natural air convection for the heat sink 10.

In use, the first surface 120 of the base 12 of the heat sink 10 thermally contacts the printed circuit boards 22 of the LED module 20 and absorbs the heat from the LEDs 24. The base 12 of the heat sink then directly transfers the heat to the first and second fins 142, 144 of the heat sink 10 to be dissipated to ambient air. The heat generated by the LEDs 24 can be very quickly dissipated to the surrounding air via the first and second fins 142, 144 of the heat sink 10, to thereby enable the LEDs 24 to work within the predetermined temperature range.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED assembly, comprising:

a plurality of printed circuit boards each having a plurality of LEDs arrayed thereon; and a heat sink to which the printed circuit boards are attached, the heat sink absorbing heat from the LEDs when the LEDs are activated, the heat sink comprising:

a base having a first surface to which the printed circuit boards are attached, and a second surface opposite to the first surface thereof; and a plurality of fins mounted on the first and second surfaces of the base and parallel to each other, a plurality of channels defined between the fins, a plurality of slits extending through two opposite sides of the base of the heat sink and corresponding fins, the slits crossing with corresponding channels, and grooves defined in the fins mounted on the second surface of the base of the heat sink and crossing with corresponding channels.

2. The LED assembly as claimed in claim 1, wherein the grooves are so arranged that each groove interconnects two aligned slits.

3. The LED assembly as claimed in claim 2, wherein the slits are oriented perpendicular to the channels of the heat sink.

4. The LED assembly as claimed in claim 2, wherein the grooves are oriented perpendicular to the channels of the heat sink.

5. The LED assembly as claimed in claim 1, wherein the fins mounted on the first surface of the base of the heat sink are located near the printed circuit boards and heights of the fins mounted on the first surface of the base of the heat sink are gradually decreased along a direction away from the printed circuit boards.

6. The LED assembly as claimed in claim 1, wherein the grooves of the heat sink are so spaced from each other that two aligned slits are located between two neighboring grooves.

7. The LED assembly as claimed in claim 6, wherein heights of the fins mounted on the second surface of the base of the heat sink are gradually decreased along a direction away from a middle portion of the base of the heat sink.

8. The LED assembly as claimed in claim 1, wherein a plurality through holes is defined through the base, adapted for extension of fixtures therethrough to mount the LED assembly to a supporting structure.

9. The LED assembly as claimed in claim 1, wherein the fins of the heat sink are integrally formed with the base of the heat sink.

10. An LED assembly comprising:

a heat sink comprising a base having opposite first and second faces, a plurality of first fins extending from the first face and a plurality of second fins extending from lateral sides of the second face; and an LED module mounted to the second face of the base of the heat sink and located between the second fins extending from the lateral sides of the second face of the base of the heat sink;

wherein a plurality of channels is defined between two neighboring ones of the first fins and two neighboring ones of the second fins along a first direction, a plurality of slits extending through the second fins, the lateral sides of the base and outer ones of the first fins located corresponding to the lateral sides of the base, the slits crossing with corresponding channels.

11. The LED assembly as claimed in claim 10, wherein a plurality of grooves is transversely defined in the first fins extending from the first face of the base, each of the grooves interconnecting two corresponding transversely aligned slits.

12. The LED assembly as claimed in claim 11, wherein two transversely aligned ones of the slits are located between two neighboring grooves along a lengthwise direction of the heat sink.

* * * * *